US008091620B2

(12) United States Patent
Gorbounov et al.

(10) Patent No.: US 8,091,620 B2
(45) Date of Patent: Jan. 10, 2012

(54) MULTI-CHANNEL FLAT-TUBE HEAT EXCHANGER

(75) Inventors: Mikhail B. Gorbounov, South Windsor, CT (US); Igor B. Vaisman, West Hartford, CT (US); Parmesh Verma, Manchester, CT (US); Lisa P. Sylvia, Tolland, CT (US); Xiaoyuan Chang, Ellington, CT (US); Gary D. Winch, Colchester, CT (US)

(73) Assignee: Carrier Corporation, Farmington, CT (US)

( * ) Notice: Subject to any disclaimer, the term of this patent is extended or adjusted under 35 U.S.C. 154(b) by 1131 days.

(21) Appl. No.: 11/793,879

(22) PCT Filed: Dec. 28, 2005

(86) PCT No.: PCT/US2005/047199

§ 371 (c)(1),
(2), (4) Date: Jun. 21, 2007

(87) PCT Pub. No.: WO2006/083435

PCT Pub. Date: Aug. 10, 2006

(65) Prior Publication Data

US 2008/0041092 A1 Feb. 21, 2008

Related U.S. Application Data

(60) Provisional application No. 60/649,433, filed on Feb. 2, 2005.

(51) Int. Cl.
*F28F 9/02* (2006.01)
*F28D 7/06* (2006.01)

(52) U.S. Cl. ..... 165/173; 165/176

(58) Field of Classification Search ..... 165/153, 165/173, 176, 149
See application file for complete search history.

(56) References Cited

U.S. PATENT DOCUMENTS

| | | | | |
|---|---|---|---|---|
| 1,843,132 | A * | 2/1932 | Huet | 165/81 |
| 1,884,555 | A * | 10/1932 | Brown | 165/84 |
| 2,297,633 | A | 9/1942 | Philipp | |
| 2,502,675 | A * | 4/1950 | Simpelaar | 165/159 |
| 2,591,109 | A | 4/1952 | Wade | |
| 2,612,350 | A * | 9/1952 | Stadler | 165/82 |
| 3,231,013 | A * | 1/1966 | Heller et al. | 165/97 |
| 3,920,069 | A | 11/1975 | Mosier | |
| 3,949,710 | A * | 4/1976 | Reisacher | 122/34 |
| 4,088,182 | A * | 5/1978 | Basdekas et al. | 165/276 |
| 4,368,778 | A * | 1/1983 | Nishimura et al. | 165/158 |
| 4,382,468 | A | 5/1983 | Hastwell | |
| 4,497,363 | A * | 2/1985 | Heronemus | 165/95 |
| 4,607,689 | A | 8/1986 | Mochida et al. | |
| 4,724,904 | A | 2/1988 | Fletcher et al. | |

(Continued)

FOREIGN PATENT DOCUMENTS

| | | |
|---|---|---|
| CN | 1566870 | 1/2005 |

(Continued)

*Primary Examiner* — Tho V Duong
(74) *Attorney, Agent, or Firm* — Cantor Colburn LLP

(57) ABSTRACT

A heat exchanger includes a plurality of flattened, multi-channel heat exchange tubes of generally J-shape extending between an inlet header and an outlet header. Each heat exchange tube has a base bend that extends horizontally between the vertically extending relatively shorter leg, which is in fluid flow communication with the fluid chamber of the inlet header, and the vertically extending relatively longer leg, which is in fluid flow communication with the fluid chamber of the outlet header.

6 Claims, 2 Drawing Sheets

U.S. PATENT DOCUMENTS

| | | | | | |
|---|---|---|---|---|---|
| 4,901,792 | A | * | 2/1990 | Komiya | 165/150 |
| 5,279,360 | A | * | 1/1994 | Hughes et al. | 165/111 |
| 5,314,013 | A | * | 5/1994 | Tanabe | 165/176 |
| 5,320,165 | A | | 6/1994 | Hughes | |
| 5,341,870 | A | | 8/1994 | Hughes et al. | |
| 5,415,223 | A | | 5/1995 | Reavis et al. | |
| 5,517,757 | A | | 5/1996 | Hayashi et al. | |
| 5,531,268 | A | * | 7/1996 | Hoshino et al. | 165/153 |
| 5,632,329 | A | | 5/1997 | Fay | |
| 5,743,329 | A | | 4/1998 | Damsohn et al. | |
| 5,826,649 | A | | 10/1998 | Chapp et al. | |
| 5,910,167 | A | | 6/1999 | Reinke et al. | |
| 5,934,367 | A | | 8/1999 | Shimmura et al. | |
| 5,941,303 | A | | 8/1999 | Gowan et al. | |
| 5,967,228 | A | | 10/1999 | Bergman et al. | |
| 5,971,065 | A | | 10/1999 | Bertilson et al. | |
| 6,142,223 | A | | 11/2000 | Bodas et al. | |
| 6,161,616 | A | * | 12/2000 | Haussmann | 165/176 |
| 6,289,981 | B1 | | 9/2001 | Tokizaki et al. | |
| 6,340,055 | B1 | | 1/2002 | Yamauchi et al. | |
| 6,439,300 | B1 | | 8/2002 | Falta et al. | |
| 6,564,863 | B1 | | 5/2003 | Martins | |
| 6,688,137 | B1 | | 2/2004 | Gupte | |
| 6,688,138 | B2 | * | 2/2004 | DiFlora | 62/525 |
| 2001/0004935 | A1 | * | 6/2001 | Sanada et al. | 165/110 |
| 2003/0116308 | A1 | | 6/2003 | Watanabe et al. | |
| 2003/0141048 | A1 | * | 7/2003 | Lee et al. | 165/177 |
| 2003/0155109 | A1 | | 8/2003 | Kawakubo et al. | |
| 2005/0269066 | A1 | | 12/2005 | Horiuchi et al. | |

FOREIGN PATENT DOCUMENTS

| | | |
|---|---|---|
| EP | 0228330 | 7/1987 |
| FR | 1258044 | 2/1961 |
| JP | 2217764 | 8/1990 |
| JP | 4080575 | 3/1992 |
| JP | 6241682 | 9/1994 |
| JP | 7301472 | 11/1995 |
| JP | 8233409 | 9/1996 |
| JP | 2002022313 | 1/2002 |

* cited by examiner

MULTI-CHANNEL FLAT-TUBE HEAT EXCHANGER

CROSS-REFERENCE TO RELATED APPLICATION

Reference is made to and this application claims priority from and the benefit of U.S. Provisional Application Ser. No. 60/649,433, filed Feb. 2, 2005, and entitled J-SHAPE MINI-CHANNEL HEAT EXCHANGER, which application is incorporated herein in its entirety by reference.

FIELD OF THE INVENTION

This invention relates generally to heat exchangers having a plurality of parallel tubes extending between a pair of headers, also sometimes referred to as a manifolds, and, more particularly, to providing fluid expansion within the an header of a heat exchanger for improving distribution of fluid flow through the parallel tubes of the heat exchanger, for example a heat exchanger in a refrigerant vapor compression system.

BACKGROUND OF THE INVENTION

Refrigerant vapor compression systems are well known in the art. Air conditioners and heat pumps employing refrigerant vapor compression cycles are commonly used for cooling or cooling/heating air supplied to a climate controlled comfort zone within a residence, office building, hospital, school, restaurant or other facility. Refrigerant vapor compression systems are also commonly used for cooling air or other secondary fluid to provide a refrigerated environment for food items and beverage products, for example, within display cases in supermarkets, convenience stores, groceries, cafeterias, restaurants and other food service establishments.

Conventionally, these refrigerant vapor compression systems include a compressor, a condenser, an expansion device, and an evaporator connected in refrigerant flow communication. The aforementioned basic refrigerant system components are interconnected by refrigerant lines in a closed refrigerant circuit and arranged in accord with the vapor compression cycle employed. An expansion device, commonly an expansion valve or a fixed-bore metering device, such as an orifice or a capillary tube, is disposed in the refrigerant line at a location in the refrigerant circuit upstream, with respect to refrigerant flow of the evaporator, and downstream of the condenser. The expansion device operates to expand the liquid refrigerant passing through the refrigerant line running from the condenser to the evaporator to a lower pressure and temperature. In doing so, a portion of the liquid refrigerant traversing the expansion device expands to vapor. As a result, in conventional refrigerant compression systems of this type, the refrigerant flow entering the evaporator constitutes a two-phase mixture. The particular percentages of liquid refrigerant and vapor refrigerant depend upon the particular expansion device employed and the refrigerant in use, for example R12, R22, R134a, R404A, R410A, R407C, R717, R744 or other compressible fluid.

In some refrigerant vapor compression systems, the evaporator is a parallel tube heat exchanger. Such heat exchangers have a plurality of parallel refrigerant flow paths therethrough provided by a plurality of tubes extending in parallel relationship between an inlet header and an outlet header. The inlet header receives the refrigerant flow from the refrigerant circuit and distributes that refrigerant flow amongst the plurality of flow paths through the heat exchanger. The outlet header serves to collect the refrigerant flow as it leaves the respective flow paths and to direct the collected flow back to the refrigerant line for return to the compressor in a single pass heat exchanger or through an additional bank of heat exchange tubes in a multi-pass heat exchanger.

Historically, parallel tube heat exchangers used in such refrigerant compression systems have used round tubes, typically having a diameter of ½ inch, ⅜ inch or 7 millimeters. More recently, flat, rectangular or oval shape, multi-channel tubes are being used in heat exchangers for refrigerant vapor compression systems. Each multi-channel tube has a plurality of flow channels extending longitudinally in parallel relationship the length of the tube, each channel providing a small cross-sectional flow area refrigerant flow path. Thus, a heat exchanger with multi-channel tubes extending in parallel relationship between the inlet and outlet headers of the heat exchanger will have a relatively large number of small cross-sectional flow area refrigerant paths extending between the two headers. In contrast, a parallel tube heat exchanger with conventional round tubes will have a relatively small number of large flow area flow paths extending between the inlet and outlet headers.

In U.S. Pat. No. 5,279,360, Hughes et al. disclosed an evaporator or evaporator/condenser for use in refrigeration or heat pump systems including a pair of spaced headers and a plurality of elongated, generally V-shape, multiple flow passage tubes of flattened cross-section extending in parallel, spaced relation between and in fluid communication within the headers. In U.S. Pat. No. 6,161,616, Haussmann discloses an evaporator for use in motor vehicle air conditioning systems having a plurality of a plurality of parallel, U-shape flow passages extending between an inlet side and an outlet side of a manifold. Each U-shape flow passage is formed of a pair of vertically extending flat multi-channel tubes interconnected at the lower ends by an end cap which serves to reverse the fluid flow from a downward flow through the first tube to an upward flow through the second tube.

Non-uniform distribution, also referred to as maldistibution, of two-phase refrigerant flow is a common problem in parallel tube heat exchangers which adversely impacts heat exchanger efficiency. Two-phase maldistribution problems are caused by the difference in density of the vapor phase refrigerant and the liquid phase refrigerant present in the inlet header due to the expansion of the refrigerant as it traversed the upstream expansion device. Obtaining uniform refrigerant flow distribution amongst the relatively large number of small cross-sectional flow area refrigerant paths is even more difficult than it is in conventional round tube heat exchangers and can significantly reduce heat exchanger efficiency.

SUMMARY OF THE INVENTION

It is a general object of the invention to reduce maldistribution of fluid flow in a heat exchanger having a plurality of multi-channel tubes extending between a first header and a second header.

In one aspect of the invention, a heat exchanger is provided having a plurality of J-shaped, multi-channel, heat exchange tubes are connected in fluid communication between an inlet header defining a chamber for receiving a fluid to be distributed amongst the channels of the heat exchange tubes and an outlet header defining a chamber for collecting fluid having traversed the channels of the heat exchange tubes. Each heat exchange tube has a plurality of fluid flow paths therethrough from an inlet end to an outlet end of the tube. The inlet end of each tube connects in fluid flow communication with the chamber of the inlet header and the outlet end of each tube connects in fluid flow communication with the chamber of the outlet header. The fluid collecting in the chamber of the inlet header flows downwardly through the respective channels of a first leg of the J-shaped heat exchange tubes and thence upwardly through the respective channels of a second leg of the J-shaped tube. In an embodiment, the heat exchanger has an outlet header disposed above the inlet header.

In another aspect of the invention, a refrigerant vapor compression system includes a compressor, a condenser and an evaporative heat exchanger connected in refrigerant flow communication. The evaporative heat exchanger includes a plurality of J-shaped, multi-channel, heat exchange tubes are connected in fluid communication between an inlet header defining a chamber for receiving a fluid to be distributed amongst the channels of the heat exchange tubes and an outlet header defining a chamber for collecting fluid having traversed the channels of the heat exchange tubes. Each heat exchange tube has a plurality of fluid flow paths therethrough from an inlet end to an outlet end of the tube. The inlet end of each tube connects in fluid flow communication with the chamber of the inlet header and the outlet end of each tube connects in fluid flow communication with the chamber of the outlet header. The fluid collecting in the chamber of the inlet header flows downwardly through the respective channels of a first leg of the J-shaped heat exchange tubes and thence upwardly through the respective channels of a second leg of the J-shaped tube. In an embodiment, the heat exchanger has an outlet header disposed above the inlet header.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1:
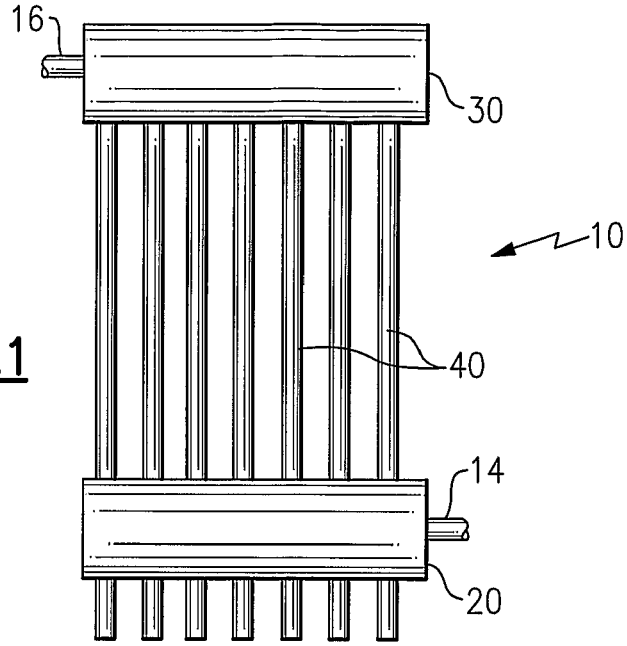
FIG. 1 is an elevation view of an embodiment of a heat exchanger in accordance with the invention.

The heat exchanger 10 includes an inlet header 20, an outlet header 30, and a plurality of longitudinally generally J-shaped, multi-channel heat exchanger tubes 40 providing a plurality of fluid flow paths between the inlet header 20 and the outlet header 30. In the depicted embodiment, the inlet header 20 and the outlet header 30 comprise longitudinally elongated, hollow, closed end cylinders defining there within a fluid chamber having a circular cross-section. However, neither the inlet header 20 nor the outlet header 30 is limited to the depicted configuration. For example, the headers might comprise a longitudinally elongated, hollow, closed end cylinder having an elliptical cross-section or a longitudinally elongated, hollow, closed end body having a square, rectangular, hexagonal, octagonal, or other polygonal cross-section.

Each heat exchange tube 40 has a plurality of parallel flow channels 42 extending longitudinally, i.e. along the axis of the tube, the length of the tube thereby providing multiple, independent, parallel flow paths between the inlet to the tube and the outlet from the tube. Each multi-channel heat exchange tube 40 is a "flat" tube of, for example, a rectangular or oval cross-section, defining an interior which is subdivided to form a side-by-side array of independent flow channels 42. The flat, multi-channel tubes 40 may, for example, have a width of fifty millimeters or less, typically twelve to twenty-five millimeters, and a height of about two millimeters or less, as compared to conventional prior art round tubes having a diameter of either ½ inch, ⅜ inch or 7 mm.

Each heat exchanger tube 40 has its inlet end 43 opening through the wall of the inlet header 20 into fluid flow communication with the fluid chamber of the inlet header and has its outlet end 47 opening through the wall of the outlet header 30 into fluid flow communication with the fluid chamber of the outlet header 30. Thus, each of the flow channels 42 of the respective heat exchange tubes 40 provides a flow path from the fluid chamber of the inlet header 20 to the fluid chamber of the outlet header 30. The respective inlet ends 43 and outlet ends 47 of the heat exchange tubes 40 may be brazed, welded, adhesively bonded or otherwise secured in a corresponding mating slot in the wall of the header 20.

The tubes 40 are shown in drawings hereof, for ease and clarity of illustration, as having twelve channels 42 defining flow paths having a circular cross-section. However, it is to be understood that in commercial applications, such as for example refrigerant vapor compression systems, each multi-channel tube 40 will typically have about ten to twenty flow channels 42, but may have a greater or a lesser multiplicity of channels, as desired. Generally, each flow channel 42 will have a hydraulic diameter, defined as four times the flow area divided by the perimeter, in the range from about 200 microns to about 3 millimeters. Although depicted as having a circular cross-section in the drawings, the channels 42 may have rectangular, triangular, trapezoidal cross-section or any other desired non-circular cross-section.

Figure 2:
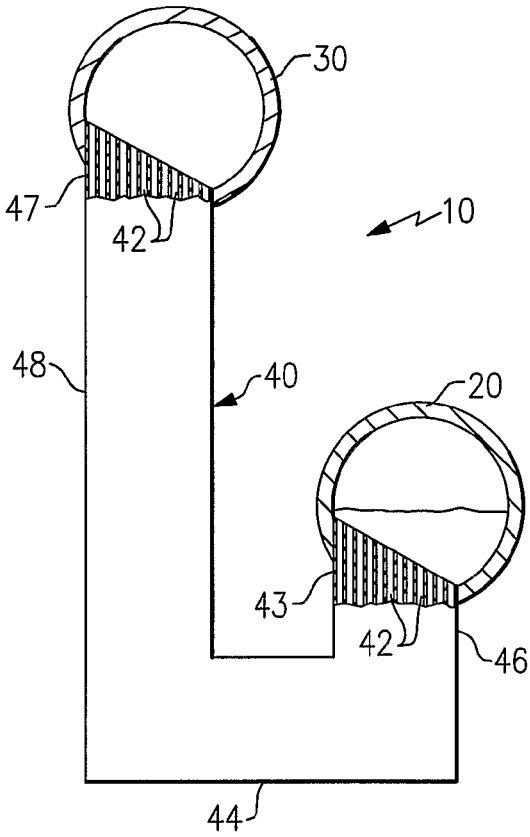
FIG. 2 is a side elevation view, partly sectioned, of the heat exchanger of FIG. 1.
Figure 3:
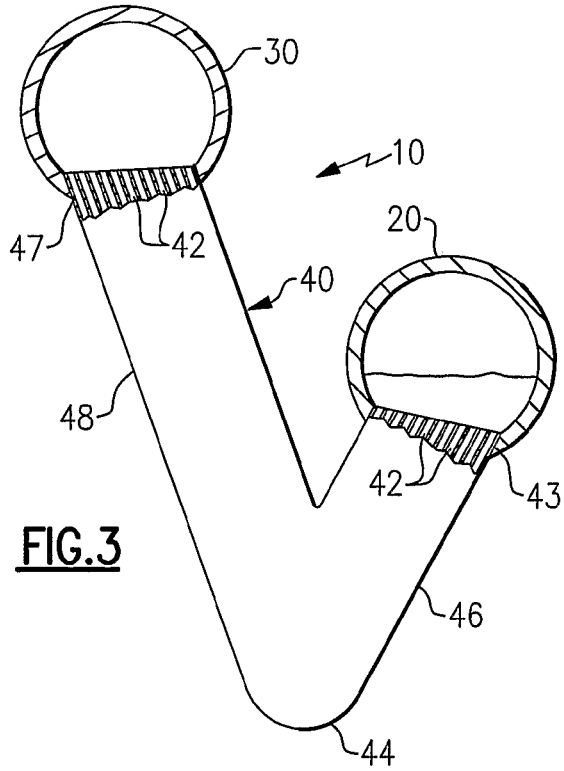
FIG. 3 is a side elevation view, partly sectioned, of another exemplary embodiment of the heat exchanger depicted in FIG. 1.

In the heat exchanger of the invention, the heat exchange tubes 40 are generally J-shaped having a base bend 44, a first leg 46 extending generally vertically upwardly from one end of the base bend 44, and a second leg 48 extending generally vertically upwardly from the other end of the base bend 44. Both the inlet header 20 and the outlet header 30 are disposed at a higher elevation than the base bend 44. Further, the outlet header 30 is disposed at a higher elevation than the inlet header 20. As depicted in FIGS. 1, 2 and 3, the inlet ends 43 of the first legs 46 of the respective heat exchange tubes 40 enter the inlet header 20 through the bottom of the header. Thus, the fluid collecting in the chamber of the inlet header flows downwardly through the respective channels 42 of the first leg 46 of the J-shaped heat exchange tubes 40 and thence upwardly through the respective channels 42 of the second leg 48 of the J-shaped heat exchange tubes 40 and into the fluid chamber of the outlet header 30.

In the embodiment of the heat exchanger 10 depicted in FIG. 2, each generally J-shape heat exchange tube 40 has a base bend 44 that extends horizontally between the vertically extending relatively shorter leg 46, which is in fluid flow communication with the fluid chamber of the inlet header 20, and the vertically extending relatively longer leg 48, which is in fluid flow communication with the fluid chamber of the outlet header 30. In the embodiment of the heat exchanger 10 depicted in FIG. 3, each generally J-shaped heat exchange tube 40 has a base bend 44 that constitutes a relatively sharp, somewhat v-shape bend. In this embodiment, the generally J-shape heat exchange 40 somewhat resembles a checkmark with the base bend 44 disposed between the generally upwardly, but not vertically, extending relatively shorter leg 46, which is in fluid flow communication with the fluid chamber of the inlet header 20, and the generally upwardly, but not vertically, extending relatively longer leg 48, which is in fluid flow communication with the fluid chamber of the outlet header 30.

Figure 4:
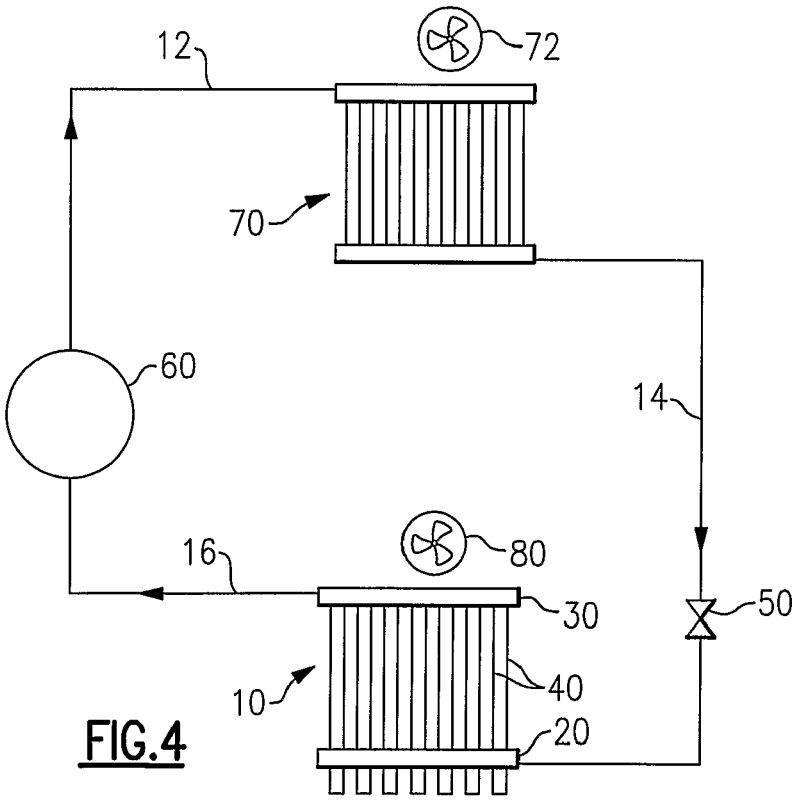
FIG. 4 is a schematic illustration of a refrigerant vapor compression system incorporating the heat exchanger of the invention.

Referring now to FIG. 4, a refrigerant compression system 100 is depicted schematically having a compressor 60, a condenser 70, an expansion valve 50, and the heat exchanger 10 of the invention functioning as an evaporator, connected in a closed loop refrigerant circuit by refrigerant lines 12, 14 and 16. As in conventional refrigeration compression systems, the compressor 60 circulates hot, high pressure refrigerant vapor through refrigerant line 12 into the inlet header of the condenser 70, and thence through the heat exchanger tubes of the condenser wherein the hot refrigerant vapor condenses to a liquid as it passes in heat exchange relationship with a cooling fluid, such as ambient air which is passed over the heat exchange tubes by the condenser fan 72. The high pressure, liquid refrigerant collects in the outlet header of the condenser 70 and thence passes through refrigerant line 14 to the inlet header 20 of the evaporator 10. The refrigerant thence passes through the generally J-shape heat exchanger tubes 40 of the evaporator 10 wherein the refrigerant is heated as it passes in heat exchange relationship with air to be cooled which is passed over the heat exchange tubes 40 by the evaporator fan 80. The refrigerant vapor collects in the outlet header 30 of the evaporator 10 and passes therefrom through refrigerant line 16 to return to the compressor 60 through the suction inlet thereto. Although the exemplary refrigerant compression cycle illustrated in FIG. 4 is a simplified air conditioning cycle, it is to be understood that the heat exchanger of the invention may be employed in refrigerant compression systems of various designs, including, without limitation, heat pump cycles, economized cycles and commercial refrigeration cycles.

As the high pressure condensed refrigerant liquid passes through refrigerant line 14 from the outlet header of the condenser to the inlet header of the evaporator, it traverses then expansion valve 50. In the expansion valve 50, the high pressure, liquid refrigerant is partially expanded either to lower pressure, liquid refrigerant or, more commonly, to a low pressure liquid/vapor refrigerant mixture. As noted previously, two-phase maldistribution problems are caused by the difference in density of the vapor phase refrigerant and the liquid phase refrigerant when a two-phase mixture is present in the inlet header 20 due to the expansion of the refrigerant as it traversed the upstream expansion device. The vapor phase refrigerant, being less dense than the liquid phase refrigerant, will naturally tend to separate and migrate upwardly within the header and collect above the level of the liquid phase refrigerant within the fluid chamber of the inlet header. Because the heat exchange tubes 40 open into the fluid chamber of the inlet header 20 through the bottom therefore, the openings to the flow channels 42 of the heat exchange tubes 40 will open into the fluid chamber beneath the surface of the liquid phase refrigerant. Therefore, gravity will assist in distributing the liquid refrigerant collected within the inlet header 20 amongst the multiplicity of channels 42 of the plurality of heat exchange tubes 40 opening to the fluid chamber of the inlet header 20. Further, gravity assists in impeding the channeling of vapor phase refrigerant preferentially through some channels 42, while other channels receive limited vapor phase refrigerant, and results in the vapor phase refrigerant being more uniformly distributed, generally by entrainment, throughout the liquid phase refrigerant. Therefore, the distribution of and the quality of the refrigerant entering the plurality of tubes multi-channel tubes 40 will be more uniform in the heat exchanger of the invention having generally J-shape heat exchange tubes as compared to conventional straight tube heat exchangers wherein the refrigerant passes upwardly from the inlet header into the flow passages defined by the those tubes.

The heat exchanger 10 of the invention has been described in general herein with reference to the illustrative single pass, parallel tube embodiment of a multi-channel tube heat exchanger as depicted. However, the depicted embodiment is illustrative and not limiting of the invention. It will be understood by one skilled in the art that various changes in detail may be effected therein without departing from the spirit and scope of the invention as defined by the claims.

We claim:

1. A refrigerant vapor compression system comprising a compressor, a condenser and an evaporative heat exchanger connected in fluid flow communication in a refrigerant circuit; said evaporative heat exchanger including:

a plurality of heat exchange tubes of flattened cross-section disposed in generally parallel spaced relationship, each tube of said plurality of heat exchange tubes having a plurality of discrete flow paths extending therethrough;

an inlet header and an outlet header, each in fluid flow communication with the refrigerant circuit, said inlet header defining a chamber for receiving refrigerant from the refrigerant circuit to be distributed amongst the plurality of flow paths of said plurality of heat exchange tubes; said outlet header defining a chamber for collecting refrigerant having traversed the plurality of flow paths of said plurality of heat exchange tubes for return to the refrigerant circuit;

each tube of said plurality of heat exchange tubes being of a generally J-shape and having a first leg having an inlet end in fluid flow communication with the chamber of said inlet header, a second leg having an outlet end in fluid flow communication with said outlet header, and a bend portion extending between the first leg and the second leg, wherein the first leg extends generally vertically upwardly a first distance from one bend of the bend portion to the inlet end in fluid communication with the chamber of said inlet header, and the second leg extends generally vertically upwardly a second distance from an opposing end of the bend portion to the outlet end in fluid communication with the chamber of said outlet header, the second distance being greater than the first distance, and said outlet header is disposed at an elevation higher than said inlet header.

2. A heat exchanger as recited in claim 1 wherein each discrete flow path has a non-circular cross-section.

3. A heat exchanger as recited in claim 1 wherein each discrete flow path has a circular cross-section.

4. A heat exchanger as recited in claim 1 wherein each tube of said plurality of heat exchange tubes comprises a non-round tube of flattened cross-sectional shape.

5. A heat exchanger as recited in claim 4 wherein each tube of said plurality of heat exchange tubes comprises a non-round tube of rectangular cross-sectional shape.

6. A heat exchanger as recited in claim 4 wherein each tube of said plurality of heat exchange tubes comprises a non-round tube of ovate cross-sectional shape.

* * * * *